United States Patent [19]

Mullins

[11] 3,947,008

[45] Mar. 30, 1976

[54] DRILL STRING SHOCK ABSORBER

[75] Inventor: Albert A. Mullins, Richmond, Tex.

[73] Assignee: Schlumberger Technology Corporation, New York, N.Y.

[22] Filed: Dec. 23, 1974

[21] Appl. No.: 535,524

[52] U.S. Cl. ..... 267/137; 267/125; 64/23

[51] Int. Cl.[2] ..... F16F 7/00

[58] Field of Search ..... 267/125, 136, 137, 154; 64/11 R, 23, 13; 175/321

[56] References Cited

UNITED STATES PATENTS

| | | | |
|---|---|---|---|
| 3,350,900 | 11/1967 | Harrison | 64/23 |
| 3,447,340 | 6/1969 | Garnett | 64/23 |
| 3,673,813 | 7/1972 | Wright | 64/11 R |

*Primary Examiner*—James B. Marbert

*Attorney, Agent, or Firm*—David L. Moseley; William R. Sherman; Stewart F. Moore

[57] ABSTRACT

In accordance with illustrative embodiments of the present invention disclosed herein, a shock absorber adapted to be incorporated in a drill string includes axially splined housing and mandrel members that enclose a resilient structure which absorbs longitudinal vibrations and shock loads and otherwise attenuates exciting forces generated by the drill bit. The resilient structure comprises inner and outer cylindrical torsion tube springs providing a low spring rate.

14 Claims, 6 Drawing Figures

DRILL STRING SHOCK ABSORBER

This invention relates generally to well drilling tools, and particularly to new and improved apparatus adapted for use above a drill bit to absorb and attenuate vibration and shock loads generated by the drilling action of the bit.

In rotary drilling, it is typical to employ a multi-cone bit at the lower end of a drill collar string which is suspended from the lower end of drill pipe extending upwardly to the surface. The entire string and the bit are rotated by a kelley and drive works at the surface to cause the bit cones to pulverize the rock and other earthen formations. Drilling fluid or "mud" is pumped down the drill string and out of orifices in the bit and returns to the surface via the well annulus to cool the bit and to carry cuttings to the surface.

The action of a cone-type bit as it advances through rock and the like produces a substantial amount of longitudinal vibration, shock loads and other cyclical exciting forces which accelerate wear and other damage to both the bit an the drill string thereabove, as well as impeding the rate of penetration of the bit. Various attempts have been made to solve such problems by incorporating a shock absorbing device above the bit. Some prior devices utilize a rubber cushion as the absorbing or damping element, however rubber tends to break down and extrude fairly readily and must therefore be replaced quite often to maintain an operable system. Moreover, the use of rubber or rubber-like material in a substantially confined space has resulted in an extremely high string rate which is considered to be undesirable. Other devices have employed a compressible gas or the like, which is difficult to maintain confined within the tool over an extended period of time, and which also provides a relatively high spring rate particularly when used at considerable depths.

It is an object of the present invention to provide a new and improved attenuating and shock absorbing apparatus for use in a rotary drill string above the bit.

A more specific object of the present invention is to provide a new and improved shock load and vibration absorbing device of the type described which utilizes mechanical components that provide a low spring rate that is much more effective in reducing wear on the bit and the drill string and in increasing the rate of penetration of the bit.

These and other objects are attained in accordance with the concepts of the present invention through the provision of an apparatus comprising mandrel and housing members coupled together for limited longitudinal relative movement and slidably splined to prevent relative rotation. To provide a yieldable resistance to such longitudinal relative movement, an elongated torsion spring tube has one end fixed to one member and the other end free. An axial cam means connected to the other member applies a couple to the free end of the spring tube in response to longitudinal movement in either direction, and the reaction torque due to wind-up of the tube tends to restore the initial relative position of the members. A chamber between the members contains a liquid such as oil which moves through a restricted flow passage means to damp out peak load changes.

The present invention has other objects and advantages which will become more clearly apparent in connection with the following detailed description of one or more embodiments thereof, taken in conjunction with the appended drawings, in which.

Figure 1:
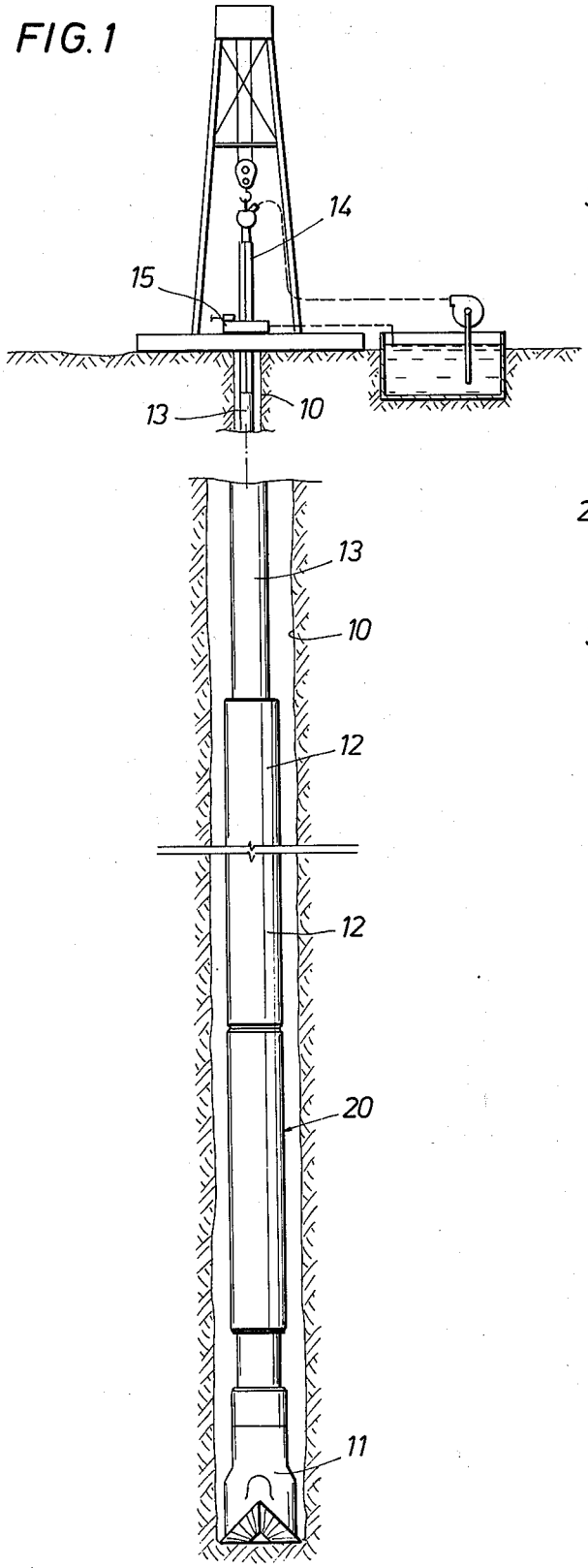
FIG. 1 is a schematic illustration of a well drilling operation employing rotary drilling techniques.

Referring initially to FIG. 1, there is shown schematically a borehole 10 being drilled into the earth using typical rotary drilling techniques. A drill bit 11 is attached to the lower end of a drill string which includes relatively heavy drill collars 12 at the lower end to weight the bit, and drill pipe 13 extending upwardly to the surface where it is attached to a kelley 14 that is driven by a rotary 15 in order to spin the entire drill string and the bit 11. A drilling fluid is pumped down the drill string and passes into the bottom of the borehole through orifices in the bit 11, and circulates back to the surface via the annulus between the drill string and the borehole wall. The drilling fluid cools the bit and carries cuttings up to the surface and provides a hydrostatic head which keeps liquids and gas in the formations penetrated by the bit from coming into the borehole.

A conventional drill bit 11 employs a plurality of rotatable cutting cones having teeth that chip and eat away at the bottom of the borehole 10 as the bit is rotated. The drilling action of the bit 11 under the weight of the drill collars 12 generates a considerable amount of vibration and shock loads which are attenuated by the incorporation of an apparatus 20, the subject of the present invention, which is connected between the lower end of the drill collars 12 and the bit 11.

Figure 2:
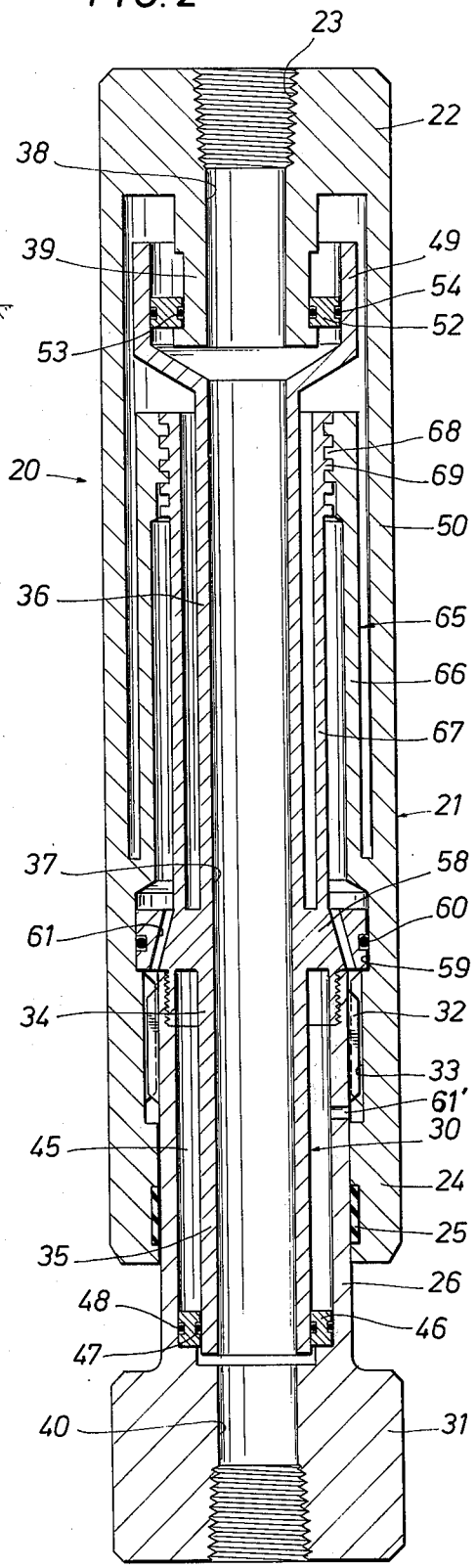
FIG. 2 is a quarter sectional view of one apparatus embodying the principles of the present invention.

Turning now to FIG. 2 for an illustration of the structural details of the apparatus 20, an elongated tubular housing 21 has its upper end portion 22 connected by threads 23 to the drill collars 12 and its lower end portion 24 sealed by a packing assembly 25 with respect to the spline sub 26 of a mandrel assembly 30 which extends upwardly into the lower end of the housing 21. The spline sub 26 has a threaded joint 31 at its lower end which is connected to the bit 11, and a plurality of axially extending external spline ribs 32 which slidably mesh with internal spline grooves 33 in the lower section 24 of the housing to prevent relative rotation. The mandrel assembly 30 further includes an elongated hollow mandrel 34 with its lower portion 35 spaced laterally inwardly of the spline sub 26, and its upper portion 36 spaced inwardly of the upper section 22 of the housing 21. The bore 37 of the mandrel 34 is axially aligned with the bore 38 of a seal sleeve 39 which depends from the upper portion 22 of the housing 21, as well as the bore 40 of the connecting joint 31, to provide a through passage for the circulation of drilling fluids.

The annular space 45 between the lower portion 35 of the mandrel 34 and the interior wall surface of the spline sub 26 is closed at its lower end by a floating annular piston 46 having inner and outer seal rings 47 and 48. The upper portion 49 of the mandrel 34 is enlarged as shown and extends upwardly into the annular space between the seal sleeve 39 and the interior wall surface of the upper housing section 50. Another floating annular piston 52 having inner and outer seals 53 and 54 is disposed between the section 49 and the sleeve 39 so that all of the interior annular spaces between the housing 21 and the mandrel assembly 30 are enclosed and can be filled with a suitable lubricant such as silicone oil or the like. The pressure of the oil will correspond to the pressure of the drilling fluids being pumped through the bore 37 of the mandrel 30 since the lower respective faces of the pistons 52 and 46 are exposed to such pressure.

An outwardly directed flange 58 may be provided on the mandrel 30 and sealed with respect to an internal cylinder surface 59 of the housing 21 by a seal ring 60. A restricted flow port 61 extends through the piston 58 so that lubricating oil can pass downwardly therethrough during upwardly relative movement of the mandrel assembly 30, and upwardly therethrough during upward relative movement of the mandrel assembly 30, and upwardly therethrough during downward relative movement.

A resilient structure indicated generally at 65 is mounted between the housing 21 and the mandrel 30 to provide a yieldable resistance to relative longitudinal movement therebetween. The structure 65 includes an outer cylindrical member 66 having its lower end fixed in a suitable manner to the housing 21, and an inner cylindrical member 67 having its lower end fixed in a suitable manner to the mandrel 34. The upper ends of the members 66 and 67 are coupled together by a helical spline system that is constituted by inwardly extending splines 68 on the outer member 66 that slidably mesh with outwardly extending splines 69 on the inner member 67, with the helix angle of the splines 68 and 69 being about 45°. As shown more clearly in FIGS. 3 and 4, the splines 68 may be formed internally of a housing 80 that is fixed to the upper end of the member 66, whereas the splines 69 may be formed on a sub 81 that is suitably fixed to the upper end of the inner tubular member 67. Thus it will be appreciated that relative longitudinal movement of the housing 21 and the mandrel 34 causes the helical spline system to apply external twisting moments in opposite rotational directions to the respective upper ends of the members 66 and 67, which results in the generation of internal resisting movements in each member tending to cause the spline system to restore the initial longitudinal relative position of the housing and the mandrel.

Figure 3:
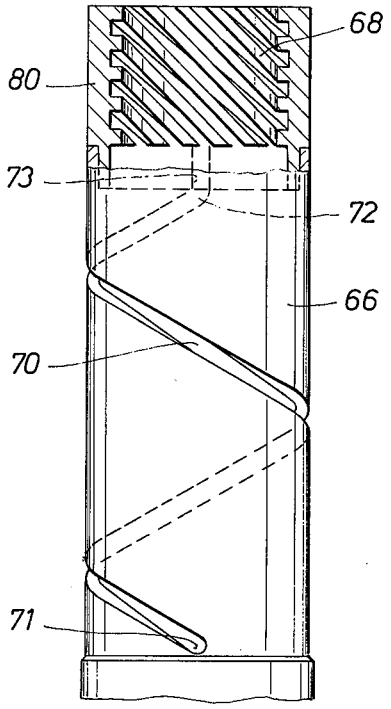
FIGS. 3 and 4 are views of the outer and inner cylindrical spring components of the apparatus shown in FIG. 2.
Figure 4:
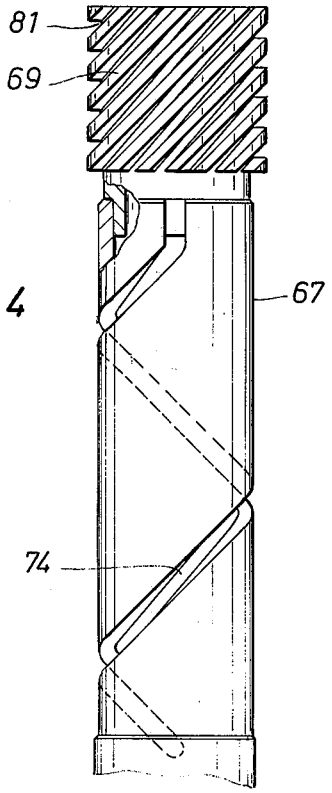

A preferred structural configuration for the members 66 and 67 is shown in FIGS. 3 and 4. The outer member 66 has a slot 70 extending along a helical path from a point 71 adjacent the lower end thereof to a point 72 near its upper end. An axially extending slot 73 opens the helical slot 70 to the upper end surface of the member 66. The inner member 67 as shown in FIG. 4 has a helical slot 74 formed therein in the same fashion except that the direction of the helix is reversed from that of the slot in the outer member 66. The slots 70 and 74 form the members 66 and 67 into cylindrical helical springs which are subjected to torsion by the action of the helical spline system described above to provide a resilient structure with a relatively very low spring rate or modulus compared to prior art devices.

In operation, the apparatus 20 is assembled as shown in the drawings and connected into the drill string just above the bit 11. The interior annular spaces between the housing 21 and the mandrel assembly 30 are filled with lubricating oil as previously described. With the bit on bottom and weighted by the drill collars 12, the housing 21 moves downwardly somewhat relative to the mandrel assembly 30 as torsion is applied to each of the cylindrical members 66 and 67 by the helical splines 68, 69. A hydraulic pressure equal to the pressure drop across the bit cone mud circulation orifices acts downwardly on the transverse cross-sectional area of the spline sub 26 adjacent the packing assembly 25 and tends to extend the mandrel 30 relative to the housing 21, with the result being that the mandrel occupies a mid-position between its limits of travel within the housing. In such position, a statical couple is applied to each of the spring tubes 66 and 67 by the splines 68, 69. Then as the drill bit 11 is rotated, vibration and shock loads that produce vertical accelerations are absorbed by the resilient action of the members 66 and 67. The system has an overall or composite spring rate that is sufficiently low to effectively smooth out the load on the bit 11 and to isolate the drill string from vibration and shock loads. The restriction in oil flow through the port 61 during relative longitudinal movement provides a dashpot effect that damps out peak load changes. The result is to reduce wear on the bit 11 and to increase its rate of penetration, as well as to reduce fatigue failure of the drill string due to cyclical stresses.

Figure 5:
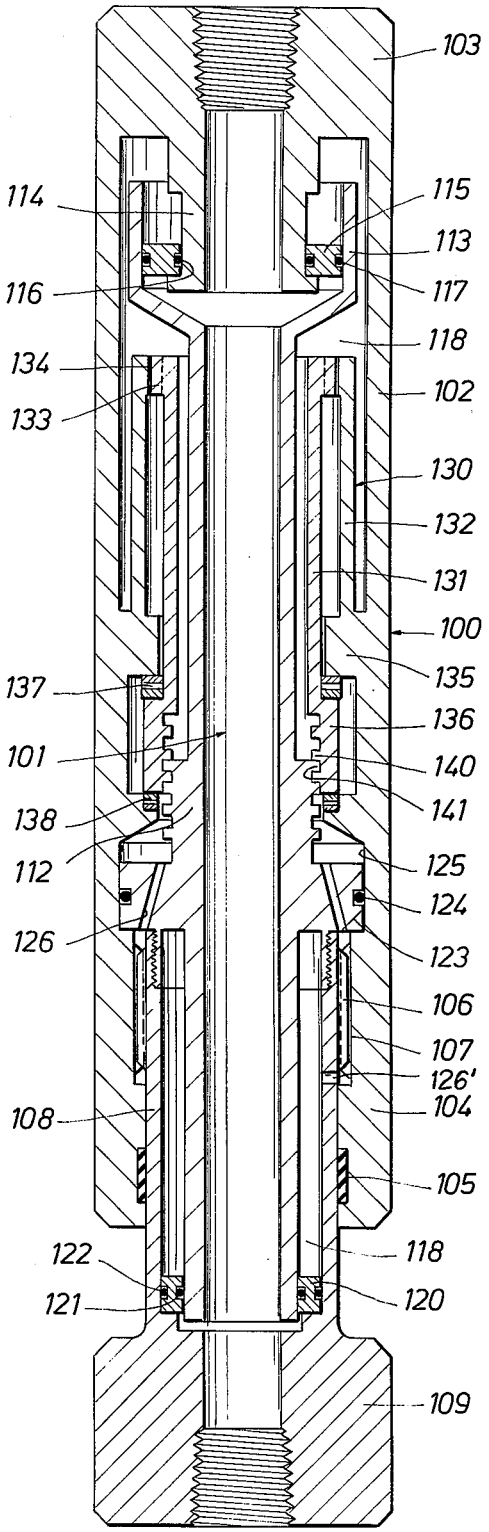
FIG. 5 is a view similar to FIG. 2 of an alternative embodiment of the present invention.

Another embodiment of the present invention is shown in FIG. 5, and is similar in overall arrangement to the previously described embodiment in comprising an elongated tubular housing 100 that is telescopically disposed for limited longitudinal relative movement with respect to a mandrel assembly 101. The upper section 102 of the housing 100 has a threaded joint 103 that connects to the drill string, and the lower section 104 thereof is sealed against the mandrel assembly 101 by a packing assembly 105. Coengaged splines 106 and 107 on the lower section 104 and a spline sub 108 of the mandrel assembly 101, respectively, prevent relative rotation, and a thread joint 109 connects the mandrel assembly to the drill bit.

The mandrel assembly 101 includes an axially extending tubular member 112 having an enlarged diameter upper portion 113 extending between the housing section 102 and a seal sleeve 114 which depends from the threaded joint 103. A floating piston 115 having seal rings 116 and 117 closes the upper end of an annular chamber space 118 between the housing 100 and the mandrel assembly 101, and a lower floating piston 120 having seal rings 121 and 122 closes off the lower end of the chamber space to enable the space to be filled with a suitable lubricating oil. Suitable means such as a damping piston 123 that has a seal ring 124 is slidably engaged with an inner wall 125 of the housing section 104 and is provided with an orifice 126 through which the lubricating oil passes during relative longitudinal movement to provide a dashpot effect.

A resilient structure 130 which affords a yieldable resistance to relative longitudinal movement is located between the housing 100 and the mandrel assembly 101, and includes an inner cylindrical helical spring 131 and an outer cylindrical helical spring 132. The upper ends of the springs 131 and 132 are coupled together by longitudinal splines 133 and 134, and the lower end of the outer spring 132 is fixed to an inwardly directed shoulder 135 on the housing 100. The lower end portion 136 of the inner spring 131 is enlarged in diameter and is mounted between upper and lower thrust bearings 137 and 138 of any suitable type, in such a manner that the portion 136 is constrained against longitudinal movement relative to the housing 100 but can rotate relative thereto.

Figure 6:
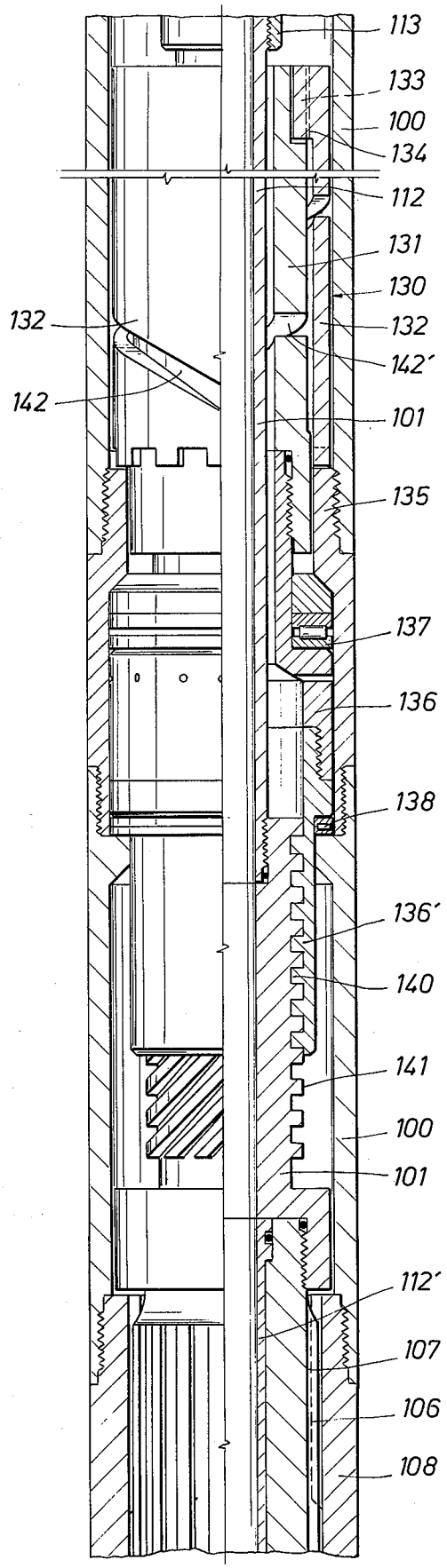
FIG. 6 is a cross-sectional view with portions in side elevation of the cylindrical spring and axial cam components of the apparatus shown in FIG. 5.

The lower portion 136 of the inner helical spring 131 has a depending skirt 136' with inwardly directed helical splines 140 as shown more clearly in FIG. 6 which mesh with companion splines 141 on the mandrel 101 to provide an axial cam means which applies an external twisting moment to the lower end of the spring 131 in response to relative longitudinal movement between the housing 100 and the mandrel assembly 101. The inner and outer springs 131 and 132 each have a helical slot 142, 142' cut substantially throughout the length thereof as in the previously described embodiment, with the slots extending in opposite rotational directions. An external twisting moment applied to the lower end of the inner spring 131 is transmitted to the outer spring 132 by the splines 133, 134 at the upper ends thereof, and generates an internal resisting moment in each member.

The principle structural difference between this embodiment and that previously described is that axial stress due to the compressive load of the drill string is transmitted directly from the housing 100 to the mandrel assembly 101 via the head 136 and the thrust bearings 137 and 138, and the helical springs 132 and 132' are subjected to torsional stresses only. This arrangement enhances the stress distribution in the cylindrical springs 131 and 132 and eliminates some points of possible excessive stress concentration. Otherwise, this embodiment operates in essentially the same manner with the cylindrical helical springs providing a resilient structure having a relatively very low spring rate to absorb and attenuate vibration and shock loads generated by the drilling action of the bit.

It now will be apparent that a new and improved vibration isolation and shock absorbing apparatus for use in a drill string has been provided. Since certain changes or modifications may be made in the disclosed embodiments without departing from the inventive concepts involved, it is the aim of the appended claims to cover all such changes or modifications falling within the true spirit and scope of the present invention.

I claim:

1. Apparatus for use in isolating a drill string from vibrations and shock loads caused by the drilling action of a drill bit, comprising: telescopically arranged mandrel and housing members adapted for connection between a drill bit and a drill string, said members being corotatively coupled and arranged for limited longitudinal relative movement; and resilient means for yieldably resisting said relative movement, including cylindrical spring means having one end fixed to one of said members, and axial cam means connected to the other of said members and coacting with the other end of said spring means for applying a twisting moment thereto in response to said longitudinal relative movement, said spring means providing a reaction torque responsive to the application of said twisting moment tending to maintain the relative longitudinal position of said members.

2. The apparatus of claim 1 further including an enclosed chamber between said members adapted to contain a fluid which is displaced by said longitudinal relative movement, and means for restricting movement of said fluid to provide a damping action in said apparatus.

3. The apparatus of claim 2 when said mandrel and housing members have axially aligned fluid passages adapted to convey drilling fluid under pressure, and seal means for preventing fluid leakage from said passages to the exterior of said members.

4. The apparatus of claim 3 wherein said mandrel member has a transverse cross-section area which is subject to the difference in the pressures of fluids within said passages and externally of said members, said difference in pressures tending to extend said members and thereby apply a statical couple to said spring means.

5. Apparatus for use in isolating a drill string from vibrations and shock loads caused by drilling action of a drill bit, comprising: telescopically arranged mandrel and housing members adapted to be connected between a drill string and a drill bit, said members being corotatively coupled and arranged for limited longitudinal relative movement; and resilient means for yieldably resisting said relative movement, including first cylindrical spring means having one end fixed to said housing and a free end, second cylindrical spring means having one end fixed to said mandrel and a free end, and axial cam means on the free end of each of said spring means cooperable with each other for applying twisting moments to each of said spring means in response to said longitudinal relative movement.

6. The apparatus of claim 5 further including tubular means within said housing and being inwardly spaced therefrom to provide an annular cavity adapted to contain a lubricating oil, said first and second spring means being located in said cavity; and means at the ends of said cavity for transmitting the pressure of a drilling fluid within said tubular means to said lubricating oil.

7. The apparatus of claim 6 wherein said mandrel member has a transverse cross-sectional area which is subject to the difference in the pressure of said lubricating oil and the pressure of a fluid externally of said members, said difference in pressure tending to extend said members and thereby apply a statical couple to said spring means.

8. The apparatus of claim 7 wherein said lubricating oil is displaced along said mandrel and housing members during said longitudinal relative movement; and means for restricting displacement of said lubricating oil to provide a damping action.

9. The apparatus of claim 5 wherein said first and second spring means each have a helical groove in the wall thereof, with the helical groove in one of said spring means extending the opposite hand direction to the helical groove in the other of said spring means.

10. The apparatus of claim 5 wherein said axial cam means comprises a splined head on each of said spring means, and helical spline means on each of said splined heads in mesh with one another for translating longitudinal relative movement to torsional stress.

11. Apparatus for use in a drill string, comprising: telescopically related mandrel and housing members corotatively coupled and arranged for limited longitudinal relative movement; and resilient means for yieldably resisting said relative movement, including first cylindrical spring means having one end fixed to said housing and a free end, second cylindrical spring means having one end portion rotatably and non-slidably coupled to said housing member and a free end, torque transmitting means on the said free ends of said spring means for transmitting twisting moments from one spring means to the other, and axial cam means on said end portion of said second spring means and said mandrel for applying twisting moments to said spring means in response to said longitudinal relative movement.

12. The apparatus of claim 11 wherein each of said spring means has a helical groove cut through the wall thereof, said torque transmitting means comprising longitudinally extending splines on each of said spring means in mesh with one another.

13. The apparatus of claim 12 wherein said axial cam means comprises helical splines on said end portion in mesh with helical splines on said mandrel member, said helical splines being formed on about a 45° helix angle.

14. The apparatus of claim 13 wherein said end portion is formed adjacent an outwardly directed shoulder on said second spring means; and thrust bearing means engaged between said shoulder and said housing member for transmitting compression loads on said housing member directly to said mandrel member via said axial cam means.

* * * * *